US007549404B1

(12) United States Patent
Martin

(10) Patent No.: US 7,549,404 B1
(45) Date of Patent: Jun. 23, 2009

(54) METHOD AND APPARATUS FOR PROVISIONING AND IGNITION OF FUEL IN AN INTERNAL COMBUSTION ENGINE

(76) Inventor: David L. Martin, Ely, IA (US); Phillip J. Martin, legal representative, 2035 Southbrook Dr., Ely, IA (US) 52227

( * ) Notice: Subject to any disclaimer, the term of this patent is extended or adjusted under 35 U.S.C. 154(b) by 0 days.

(21) Appl. No.: 11/834,676

(22) Filed: Aug. 6, 2007

Related U.S. Application Data

(60) Provisional application No. 60/953,885, filed on Aug. 3, 2007, provisional application No. 60/821,607, filed on Aug. 7, 2006.

(51) Int. Cl.
*F02P 23/04* (2006.01)

(52) U.S. Cl. ..... 123/143 B

(58) Field of Classification Search ..... 123/143 B
See application file for complete search history.

(56) References Cited

U.S. PATENT DOCUMENTS 4,947,640 A * 8/1990 Few et al. ..... 60/776
5,073,896 A * 12/1991 Reid et al. ..... 372/59
5,090,020 A * 2/1992 Bedwell ..... 372/59
6,428,307 B1 * 8/2002 Early et al. ..... 431/1
6,514,069 B1 * 2/2003 Early et al. ..... 431/1
6,676,402 B1 * 1/2004 Early et al. ..... 431/1
7,350,493 B2 * 4/2008 Scarisbrick et al. ..... 123/143 B
7,421,166 B1 * 9/2008 Woodruff et al. ..... 385/39
2004/0004986 A1 * 1/2004 Cherne et al. ..... 372/55
2005/0063646 A1 * 3/2005 Gupta et al. ..... 385/88
2006/0055925 A1 * 3/2006 Yalin et al. ..... 356/318
2007/0000465 A1 * 1/2007 Scarisbrick et al. ..... 123/143 B

* cited by examiner

*Primary Examiner*—Erick Solis
(74) *Attorney, Agent, or Firm*—Simmons Perrine Moyer Bergman PLC

(57) ABSTRACT

An apparatus and method for ignition of an internal combustion engine comprising a pumped gas laser which provides laser light to a distributor which provides laser light of sufficient power to engine cylinder where ignition can occur and humid air alone can be sufficient for fuel.

6 Claims, 4 Drawing Sheets

METHOD AND APPARATUS FOR PROVISIONING AND IGNITION OF FUEL IN AN INTERNAL COMBUSTION ENGINE

CROSS-REFERENCES TO RELATED APPLICATIONS

This application claims the benefit of the filing dates of the following two co-pending provisional applications: Application No. 60/953,885 entitled "The Laser Combustor", which was filed on Aug. 3, 2007, and Application No. 60/821,607 entitled "Laser Combustor" filed on Aug. 7, 2006, both of which are incorporated herein in their entirety by this reference.

FIELD OF THE INVENTION

The present invention relates to internal combustion engines and ignition and fuel systems for such engines.

BACKGROUND OF THE INVENTION

In the past, the United States has been dependent upon foreign oil. In the 1970s, foreign oil was thought by many to be the major reason for a recession in the U.S. as the oil was withheld from the market, driving the price of gasoline up as the demand continued to grow. As a result of this dependency, the Federal Government put a 55 mile-per-hour speed limit into effect while the U.S. auto industry began a fuel economy program that has extended to the present time.

There is nothing new about rethinking the automotive power system; it has long been known that the internal combustion engine (the Otto cycle) has inherent inefficiencies which may be on the order of 30% efficient. E. F. Lindsley from his September 1979 Popular Science article entitled "More Miles From a Barrel of Crude" stated as follows > "... To get ourselves out of this trap, some experts contend, we're going to have to go back and examine the entire combustion process in detail, finding new ways of igniting and burning fuel. Then we'll have to redesign engines that cannot only get better mileage, but run on fuels that can be extracted in greater quantity from each barrel of crude ... "

While fuel injection, turbo-charging and super charging, as well as alternate fuels such as ethanol and E-85 have been successfully implemented in the past, they still have some drawbacks. The most salient of these drawbacks is that they still require relatively high amounts of gasoline or ethanol-based fuel.

Consequently, there exists a need for improved methods and systems for fueling and ignition of fuel in an internal combustion engine.

SUMMARY OF THE INVENTION

It is an object of the present invention to provide enhanced fuel consumption characteristics for internal combustion engines.

It is a feature of the present invention to include an extremely high energy apparatus for igniting fuel in an internal combustion engine.

It is an advantage of the present invention to achieve combustion of even the humid air component of vaporized fuel mixture.

It is another object of the present invention to reduce harmful emissions of internal combustion engines.

It is another feature of the present invention to dramatically reduce, if not eliminate the need for gasoline, diesel, or ethanol-based fuel for internal combustion engines.

It is another advantage of the present invention to reduce cost of operation of an internal combustion engine by using less expensive fuel.

The present invention is a method and apparatus for fueling and ignition of fuel in an internal combustion engine, which is designed to satisfy the aforementioned needs, provide the previously stated objects, include the above-listed features and achieve the already articulated advantages. In the present invention, the normal gasoline, diesel and ethanol-based fuel required for operation has been reduced, if not completely eliminated.

Accordingly, the present invention is a method and apparatus for combustion in an internal combustion engine which uses a laser-like ignition system which provides such enhancement in the ignition that the humid air component of the fuel is itself combusted as fuel.

BRIEF DESCRIPTION OF THE DRAWINGS

The invention may be more fully understood by reading the following description of the preferred embodiments of the invention, in conjunction with the appended drawings wherein.

DETAILED DESCRIPTION OF THE DRAWINGS

Figure 1:
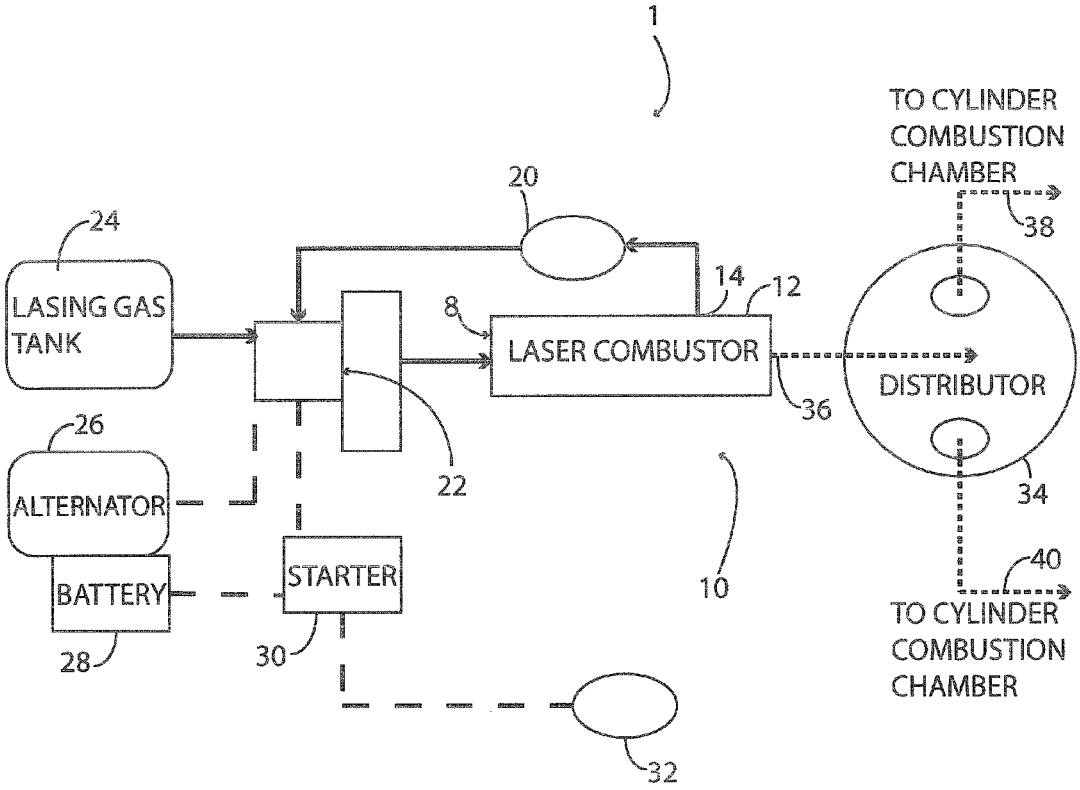
FIG. 1 is a block diagram of the major functional components of a gas laser ignition system of the present invention, where the dashed lines represent electrical connections, the solid arrowed lines represent fluid flow connections, and the dashed and dotted lines represents optical connections.

Now referring to the drawings, wherein like numerals refer to like matter throughout, and more specifically to FIG. 1, there is shown a laser combustor system 1 comprising a laser gas tank 24, a rotary compressor (or pump) 22, the laser combustor 10, and a distributor 34. The system is activated when the ignition key 32 is turned on and energizes the starter 30 to crank the engine while concurrently energizing the compressor. The compressor 22 retrieves laser gas (10% carbon dioxide, 10% nitrogen, and 80% helium) from the tank 24, compresses it e.g. in one embodiment to double the tank pressure, and forces it into the laser combustor 10, where it forces the carbon dioxide to lase while the remainder of the gases are recycled back through the recycle port 14 to the compressor 22. The laser beam (dashed and dotted lines) passes out of the combustor 10 to the distributor 34 via a fiber optic link 36, where it is distributed to individual cylinder combustion chambers through fiber optic links 38 and 40 to cylinders.

The laser combustor 10 consists of a nozzle body GDT-100, a cavity GDT-101, and a take-away ring GDT-102. Pressurized gas from the rotary compressor 22 is fed to the reservoir end 8 of the combustor 10, through the supersonic nozzle throat 13 where it is adiabatically expanded in the receiver 15, causing the gas to lase. This lasing results in a beam of coherent single-phase photons being forced into the cavity GDT-101 where it intensifies until it can penetrate the concave lens 140 of the cavity and be fed to the distributor 34 via a fiber optic cable 36. Gases that do not lase are passed to the take-away ring GDT-102 and recycled back to a pressure sensor 20 that shuts off the tank gas and admits the recycle gas back to the compressor 22.

Figure 7:
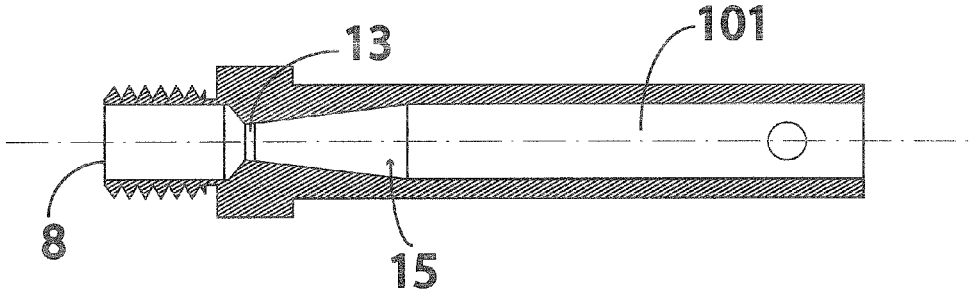
FIG. 7 is a cross-sectional view of a portion of the laser combustor 10 of FIGS. 1 and 2.
Figure 8:
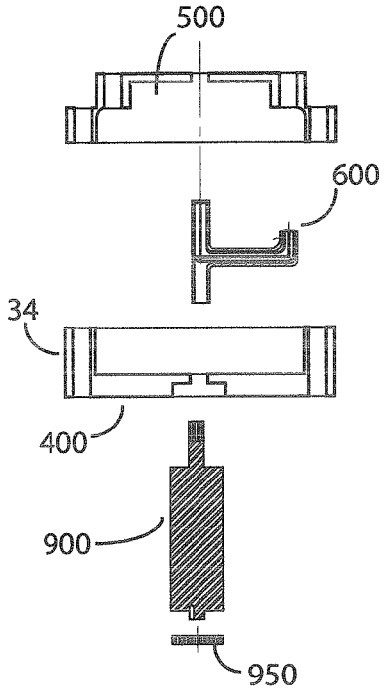
FIG. 8 is an exploded view of a distributor of the present invention.
Figure 9:
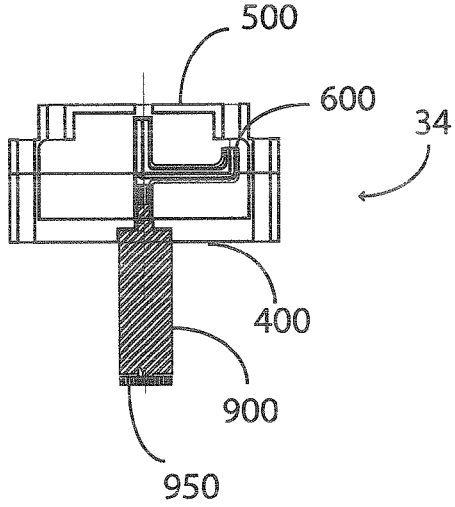
FIG. 9 is a non-exploded view of the distributor of FIG. 8.
Figure 10:
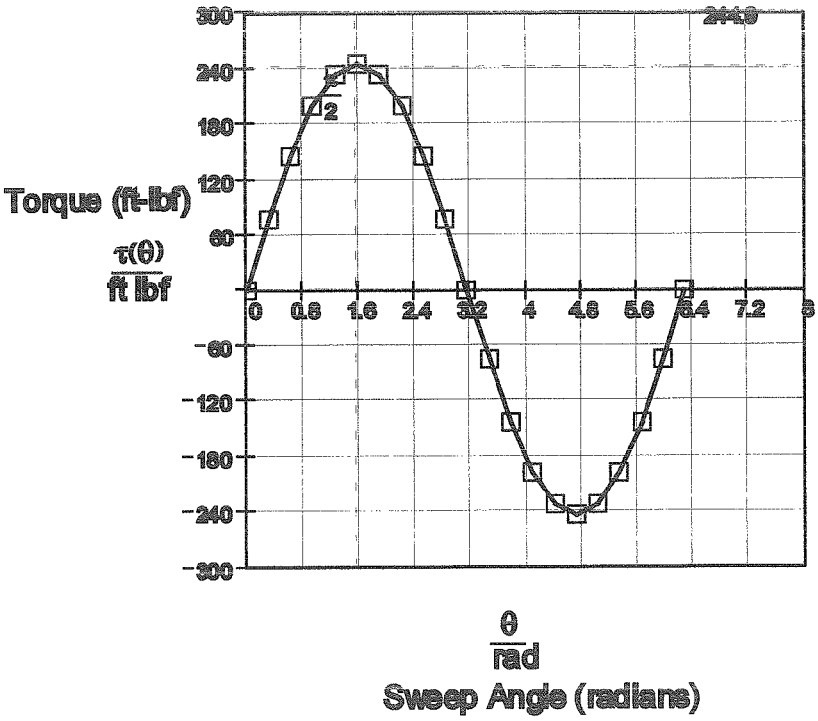
FIG. 10 is a graph of torque vs. camshaft sweep angle.

The Nozzle Body GDT-100 is shown in FIG. 7. The supersonic nozzle throat 13 is the critical part of the body where the lasing gas is first compressed, then adiabatically expanded, causing the gas mixture to cool rapidly. The system 1 could function as described in the following quote from the book Principles of Laser Plasmas by Bekefi.

> "... The operation of the gas dynamic $CO_2$ laser has made available large amounts of thermal energy obtainable in a combustion process for the pumping of a laser. This technique makes it possible to operate very large lasers without first converting thermal energy into electrical energy which in turn is utilized to energize the laser. It is important to note that the gas dynamic laser is a thermally pumped system. The operation of this laser starts with a hot equilibrium gas mixture in which there is no inversion. This hot gas mixture is rapidly expanded through a supersonic nozzle (the mixture is 80% helium, 10% carbon dioxide, and 10% nitrogen). Since the v=1 vibrational state of nitrogen is metastable, this gas does not cool as rapidly as the hot $CO_2$ gas. Collision between the cold carbon dioxide and the still hot nitrogen molecules during and after the expansion provides the population inversion for the operation of the laser ... "

Figure 3:
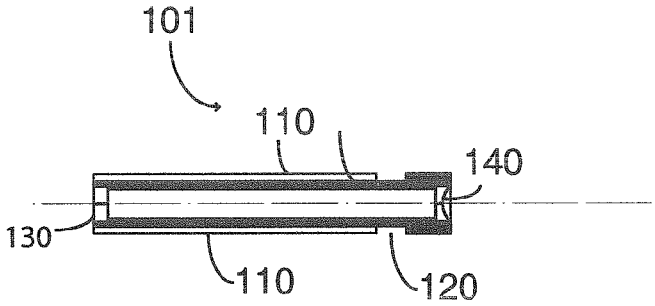
FIG. 3 is a cross-sectional view of a portion of the laser combustor 10 of FIG. 1.

The cavity GDT-101 contains the lens apparatus for propagating and intensifying the laser beam generated in the body receiver. An additional function of the cavity 101 is to provide separation between the laser beam and lasing gas so that the gas can be recycled to the compressor 22. As the excited gas molecules exit the nozzle throat 13, lasing is initiated per the description above and as the photon beam intensifies, it penetrates the flat coated lens 130 of the cavity 101, where it passes back and forth between the coated flat lens and the concave coated lens 140 shown in FIG. 3. As the beam intensifies, it will eventually penetrate the coating of the concave lens 140 and exits the cavity 101 to a fiber-optic link 36 that carries it to the distributor 34.

The gas mixture that does not lase passes through the longitudinal splines 110 of the cavity 101 to a terminating groove 120 that carries the mixture out through the cross-drilled holes of the body for recycle.

Figure 4:
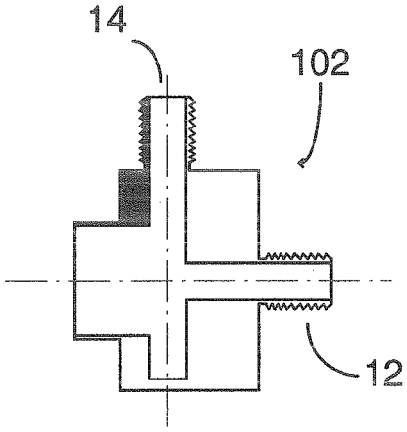
FIG. 4 is a cross-sectional view of a portion of the laser combustor 10 of FIG. 1.
Figure 5:
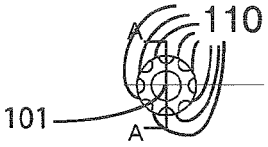
FIG. 5 is an end view of the cavity 101 of FIG. 3.
Figure 6:
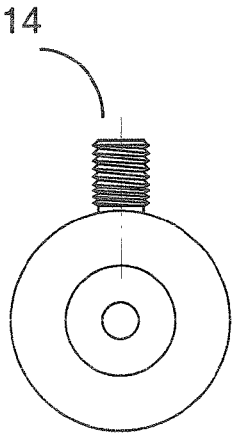
FIG. 6 is an end view of the laser combustor 10 of FIG. 2.

The final component of the combustor is the take-away ring GDT-102. The function of the take-away ring is to provide a pathway for the gas mixture to be recycled to the compressor. This is accomplished by way of the internal groove cut into the ring. The groove matches up with the cross-drilled holes in the body, which match up with the terminating groove of the cavity 101. The take-away ring GDT-102 is shown in FIG. 4.

Figure 2:
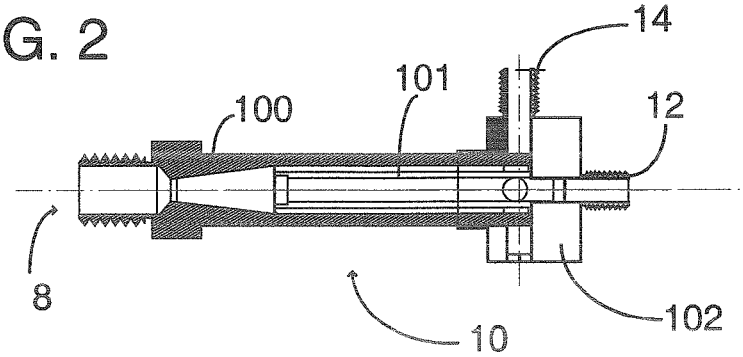
FIG. 2 is a cross-sectional view of the laser combustor 10 of FIG. 1.

The combustor assembly is shown in FIG. 2.

The distributor system 34 connects to the combustor assembly 10 through a fiber optic link 36 from the take-away ring GDT-102 to the distributor arm GD600, which extends through the distributor cover GD500. The distributor arm GD600 is fixed with a soft metal bearing to the driver shaft GD900, which is terminated with a camshaft gear GD950, geared to the engine camshaft to rotate at the same speed as the camshaft. The distributor cover GD500 as shown has eight 1 outlet bosses which connect to fiber optic links 38 and 40 to the cylinders. As the internal fiber optic accepts the laser beam and rotates at the engine rpm, the laser beam is directed to the appropriate outlet boss and to the corresponding cylinder. The terminal end of the cylinder optic link is comprised of a focusing coupler, which is externally threaded to match the spark plug thread. The beam is focused through the coupler and emitted into the cylinder combustion chamber at precisely the right time to superheat the moist air that has been drawn into the combustion chamber through the air intake and engine galley. Superheated air is then compressed by the power stroke and the resulting instantaneous pressure gradient forces the piston downward, imparting rotational torque to the crankshaft.

1 The number of outlets is equal to the number of engine cylinders. This example has eight (8) outlets.

Individual component part prints are included for further clarity.

The present invention may be more easily understood and implemented when example is considered in depth.

A 1982 Ford V8 Cleveland engine was chosen in 1982 as the model for this project. While there have been many advances in engine design and technology since 1982, there does not appear to any technical reason why the relationships discussed in this paper should require recalculation to reflect these newer, more advanced engines of today. In fact, torque capabilities in current engines are similar to those of the 80's, while the power budgets of the newer engines are less. This means that a smaller laser combustor would be required to do the work of the fuel and that no other significant changes to the concept of the laser combustor would be needed. The relevant specifications of the Cleveland engine are shown in TABLE 1 below:

Cleveland Engine Specifications:

| | |
|---|---|
| Displacement | $V := 302 \cdot in^3$ |
| Torque @ 1800 rpm | $\tau := 240 \cdot ft \cdot lbf$ |
| Stroke | $s := 3.0 \cdot in$ |
| Bore | $d := 4.0 \cdot in$ |
| Compression Ratio | $r := 8.4$ |
| Specific Heat Ratio | $\gamma := 4.739$ |
| Cylinders | $n := 8$ |

pVT Parameters:

| | |
|---|---|
| Initial fuel temperature (assumed) | $T_o := 60 \cdot F.$ |
| Initial cylinder pressure (assumed) | $p_o := 14.696 \cdot psi$ |
| Initial cylinder volume (intake stroke) | $V_o := V \cdot n^{-1}$ |
| Compression temperature of fuel | $T_c := T_o \cdot r^{\frac{(\gamma-1)}{\gamma}}$ |
| Compression pressure of fuel | $p_c := r \cdot p_o$ |
| Compression volume of fuel | $V_c := V_o \cdot r^{-1}$ |

The ignition parameters are found by first assuming that the ignition temperature is equal to the temperature of formation of nitrous oxide (NO), which is $T_{NO} := 325 \cdot F$, and that the ignition volume is equal to the compression volume a ($V_i := V_c$). The ignition pressure can then be calculated as follows:

Equation 1.0 . . . Ignition Pressure $$p_i := p_c \cdot \left(\frac{V_c}{V_i}\right) \cdot \left(\frac{T_{NO}}{T_c}\right)$$

$p_i = 1.247 \cdot 10^3 \circ \text{psi}$

Finally, by noting that the exhaust volume is the same as the initial volume ($V_e := V_o$) the exhaust temperature and pressure can be calculated.

Equation 1.1 . . . Exhaust Temperature $$T_e := \frac{(T_o \cdot T_{NO})}{T_c}$$

$T_e = 606.235\ \text{F}$

Equation 1.2 . . . Exhaust Pressure $$p_e := p_i \cdot \left(\frac{V_i}{V_e}\right) \cdot \left(\frac{T_e}{T_{NO}}\right) \quad p_e = 27.698 \circ \text{psi}$$

Thermodynamic Properties

Given that the mechanical efficiency of an IC engine is only about $\epsilon_m := 75 \cdot \%$, then the energy produced and the work required to produce it can be calculated using the specific heal at constant volume, $c_v := 5 \cdot \text{BTU} \cdot (\text{mol} \cdot \text{F})^{-1}$ as follows:

Equation 1.3 . . . Compression Work $$W_c := c_v \cdot \left[\frac{(T_o - T_c)}{\varepsilon_m}\right]$$

$$W_c = -1.744 \cdot 10^3 \circ \frac{\text{BTU}}{\text{mol}}$$

Equation 1.4 . . . Ignition Energy Requirement $Q_i := c_v \cdot (T_{NO} - T_c)$ $$Q_i = 1.464 \cdot 10^4 \circ \frac{\text{BTU}}{\text{mol}}$$

Equation 1.5 . . . Expansion Work $W_x := c_v \cdot (T_{NO} - T_e) \cdot \epsilon_m$ $$W_x = 9.914 \cdot 10^3 \circ \frac{\text{BTU}}{\text{mol}}$$

Equation 1.6 . . . Exhaust Energy $Q_x := c_v \cdot (T_e - T_{NO})$ $$Q_x = -1.322 \cdot 10^4 \circ \frac{\text{BTU}}{\text{mol}}$$

Equation 1.7 . . . Thermal Efficiency $$\xi := \frac{(W_c + W_x)}{Q_i}$$

$\xi = \mathbf{55.798} \circ \%$

It is also important to calculate the time in which these pVT parameters are satisfied because they must be met by the laser combustor as well;

Equation 1.8 . . . Specific fuel flowrate (assuming and engine speed of $\omega := 1800 \cdot \text{rpm}$ and a period of revolution $\text{oft} := 0.033 \cdot \text{sec}$ $$\psi := \frac{V_c}{rev} \cdot \left(\frac{\text{ft}^3}{1728 \cdot \text{in}^3}\right) \cdot \left(\frac{\text{mol}}{359 \cdot \text{ft}^3}\right)$$

$$\psi = 7.244 \cdot 10^{-6} \circ \frac{\text{mol}}{rev}$$

Equation 1.9 . . . Energy Delivery Rate $\phi_m := Q_i \cdot \psi$ $\phi_m = 0.106 \circ BTU \cdot rev^{-1}$ This amount of energy must be delivered by the laser combustor, assuming the same fuel characteristics. However, a non-hydrocarbon fuel, such as moist air, will not have the internal energy that gasoline possesses, therefore the combustor will have to make up for that deficiency. It is also important to note that the energy delivery rate is required at every combustion chamber at speed, or at every 3.3 milliseconds, assuming 1800 rpm. Equations 1.0 through 1.9 all are required in order to calculate the torque in the engine.

Torque is the vector product of a lever arm (one half the piston rod length) and the cylinder pressure across the cross-sectional area of the piston, multiplied by the sine of the sweep angle during the power stroke of the engine. The lever arm is represented by the lower articulated portion of the piston connecting rod, and governs the stroke of the connecting rod/piston combination during the operation of the engine. If the previous equation results are correct, one should be able to calculate the torque of the test engine and compare that value to the specifications in TABLE 1.

Equation 1.10 . . . Piston Cross-Sectional Area $$A_p := \left(\frac{\pi}{4}\right) \cdot d^2$$

$A_p = 12.566 \circ \text{in}^2$

The independent variable is the sweep angle of the camshaft such that the angle is defined by θ

$$\theta := 0 \cdot \text{rad}, \left(\frac{\pi}{10}\right) \cdot \text{rad} \ldots 2 \cdot \pi \cdot \text{rad}.$$

The actual force on the piston is $$F := \left(\frac{p_i}{n}\right) \cdot A_p$$

and the torque is given by

Equation 1.11 . . . Torque $$\tau(\theta) := \left(\frac{s}{2}\right) \cdot F \cdot \sin(\theta)$$

| $\frac{\tau(\theta)}{\text{ft}\cdot\text{lbf}} =$ | |
|---|---|
| 0.000 | Torque (ft · lbf) |
| 75.680 | |
| 143.952 | |
| 198.132 | |
| 232.919 | |
| 244.905 | |
| 232.919 | |
| 198.132 | |
| 143.952 | |
| 75.680 | |
| $2.999 \cdot 10^{-14}$ | |
| −75.680 | |
| −143.952 | |
| −198.132 | |
| −232.919 | |
| −244.905 | |

Heat will have to be put into the system and will have to diffuse at similar rates for the laser combustor to be successful. The gasoline mixture has an average thermal conductivity of $$k_m := 0.595 \cdot \frac{\text{BTU}}{\text{hr}\cdot\text{in}\cdot F},$$

and the chemical heat generation term (from the gasoline) is given by $Q_r := Q_i \cdot \psi$. Then the cylinder heat flux in the existing system is Equation 1.12 . . . Cylinder Heat Flux $$q_r := \frac{Q_r}{A_p}$$

$$q_r = 8.441 \cdot 10^{-3} \circ \frac{\text{BTU}}{\text{in}^2 \cdot rev}$$

Equation 1.13 . . . Fuel Diffusivity

The specific heat capacity is $c_p = 0.29 \cdot \text{BTU} \cdot (\text{lb} \cdot \text{F})^{-1}$ and the mixture density is $\rho := 0.02 \cdot \text{lb} \cdot \text{ft}^{-3}$, so the diffusivity is $$\alpha_g := \frac{k_m}{\rho \cdot c_p}$$

$$\alpha_g = 49.241 \cdot \frac{\text{in}^2}{\text{sec}}$$

Section 2: Some Gas Dynamic Laser Properties

" . . . The laser is one of those very rare inventions that changes one's perspective of the world . . .

Robert M. Hill

Charles K. Rhodes

Principles of Laser Plasmas

A basic law of physics is that when a body reacts with another body, there is a reaction according to the laws of Newton, " . . . for every action, there is an equal and opposite reaction . . . ". It is also known that mass and energy are conserved in this universe as we know it. These two basic laws of physics form the underpinning of gas dynamic laser theory.

When an electron from the orbit of one speci of molecule interacts with an electron of another molecule (the same species or not), the incoming electron imparts energy to the recipient electron, causing it to become "excited". The excited electron moves into an orbit further away from the nucleus of its parent atom . . . an orbit of higher energy. But nuclear forces are so great that the electron is quickly "pulled" back to its original orbit, or ground state. This ground state tendency for all matter is the result of nature always wanting to "settle" into an equilibrium position with the matter around it. The reaction of the electron is that in order to go back to its ground state, it will emit a packet of light energy, called a photon. This photon emission results in lowering the electron energy so that it can fall back to ground state, while the photon is emitted as light energy. If, in the course of its travel, the emitted photon strikes another electron, the entire excitation process is repeated and the eventual result is a homogeneous, coherent stream of light photons being emitted from the laser cavity.

There are many types of lasers in use and theoretically any type of material can be made to lase provided the excitation energy is sufficient. The gas dynamic carbon dioxide laser will be the laser used in this paper, and the choice for a gas dynamic mixing laser is based on the fact that large electronic components are not required to fire the unit.

" . . . The operation of the gasdynamic $CO_2$ laser has made available large amounts of thermal energy obtainable in a combustion process for the pumping of a laser. This technique makes it possible to operate very large lasers without first converting thermal energy into electrical energy which is in turn utilized to energize the laser. It is important to note that the gas dynamic laser is a thermally pumped system. The operation of this laser starts with a hot equilibrium gas mixture in which there is no inversion. This hot gas mixture is rapidly expanded through a supersonic nozzle (the gas mixture is 80% helium, 10% carbon dioxide, and 10% nitrogen). Since the v=1 vibrational state of nitrogen is metastable, this gas does not cool as rapidly as the hot $CO_2$ gas. Collision between the cooled carbon dioxide and the still hot nitrogen molecules during and after the expansion provide the population inversion for the operation of the laser . . . "

Researchers have observed the fundamental vibrational frequencies of both carbon dioxide and nitrogen. While CO2 possesses three such frequencies, N2 is observed to possess only one. The specific energy of the vibrational levels of both nitrogen and carbon dioxide obey the following relationship, where the fundamental vibrational frequencies of both molecules are as follows (where j:=1, 2 . . . 3):

| | | |
|---|---|---|
| Carbon Dioxide: | First vibrational | $\omega_1 := 2.5\cdot 10^{14}\cdot sec^{-1}$ |
| | Second vibrational frequency | $\omega_2 := 1.3\cdot 10^{14}\cdot sec^{-1}$ |
| | Third vibrational frequency | $\omega_3 := 4.4\cdot 10^{12}\cdot sec^{-1}$ |
| Nitrogen: | Sole frequency | $\omega_N := 4.4\cdot 10^{12}\cdot sec^{-1}$ |

Equation 2.0 . . . Molecule Specific Energy $$E_j := [\zeta\cdot\omega_j\cdot(j+0.5)]\cdot(1.602\cdot 10^{19}\cdot eV\cdot joule^{-1})$$

$$\frac{E_j}{eV} = \begin{array}{|c|}\hline 3.981 \\ \hline 3.450 \\ \hline 0.163 \\ \hline\end{array}$$

$$\text{For nitrogen } E := [\zeta\cdot\omega_N\cdot(3+0.5)]\cdot 1.602\cdot 10^{19}\cdot eV\cdot joule^{-1}$$

$$\frac{E}{eV} = 0.163$$

Given that both the carbon dioxide and nitrogen are at the same energy level when they both exhibit the third resonant frequency, one can conclude that both molecules are at the same absolute temperature at that time. The absolute temperature is given (using Boltzman's Constant and Avagadro's Number):

Equation 2.1 . . . Molecular Absolute Temperature

For carbon dioxide:

$$T(j) := \frac{2\cdot E_j}{3\cdot\sigma}$$

$$T_1 := (2)\cdot\frac{(3.981\cdot eV)}{3\cdot\sigma} \quad T_2 := \frac{(2\cdot 3.450\cdot eV)}{3\cdot\sigma} \quad T_3 := \frac{(2\cdot 0.163\cdot eV)}{3\cdot\sigma}$$

$$T_1 = 5.552\cdot 10^4\circ R \quad T_2 = 4.812\cdot 10^4\circ R \quad T_3 = 2.273\cdot 10^3\circ R$$

The absolute temperature of the nitrogen is the same as $T_3$, while the helium acts only as a buffer in this reaction, and remains at the original temperature of $T_o$=60.000 F The molecules obey the Maxwell-Boltzman Distribution Law, which estimates the number of molecules at each energy level of the species. Therefore, for carbon dioxide, the distribution of molecules at each absolute temperature is found from Equation 2.2 . . . Maxwell-Boltzman Distribution Law $$n_j := 2\cdot N\cdot[\sinh((0.5\cdot\sigma\cdot T_j))^{-1}\cdot\zeta\cdot\omega_j]\cdot e^{-\left[\zeta\cdot\omega_j\cdot\frac{(j+0.5)}{\zeta\cdot T_j}\right]}$$

For carbon dioxide:

$n_1$:=0.0985 $n_2$:=0.1353 $n_3$:=0.3656 as a percentage of all $CO_2$ molecules in the process.

Therefore, the average bulk temperature of the carbon dioxide is $$T_{CO} := n_1\cdot T_1 + n_2\cdot T_2\cdot n_3\cdot T_3$$

$$T_{CO} = 1.281\cdot 10^4\circ R$$

Likewise for nitrogen, $n_n$:0.3658 and $T_n := n_n\cdot T_3$ $$T_n = 831.596\circ R$$

The lasing gas has the following makeup:

Mole fraction Carbon Dioxide . . . $x_{co}$:=0.10·%

Mole fraction Nitrogen . . . $x_n$:=0.10·%

Mole fraction Helium . . . $x_h$:=0.80·%

Therefore, a mole of lasing gas consists of for $C_2$ . . . $x_{co}\cdot N = 6.0238\cdot 10^{20}\circ molecule\cdot mol^{-1}$ shown as $\Gamma_{co}$ for $N_2$ . . . $x_n\cdot N = 6.0231\cdot 10^{20}\circ molecule\cdot mol^{-1}$ shown as $\Gamma_v$ for He . . . $x_h\cdot N = 4.818\cdot 10^{21}\circ molecule\cdot mol^{-1}$ shown as $\Gamma_h$ The actual bulk temperature of the lasing gas is found from Equation 2.3 . . . Bulk Temperature of Lasing Gas $$T_b := 0.1\cdot T_{co} + (1-0.1)\cdot T_o + 0.1\cdot T_n + (1-0.1)\cdot T_o + 0.8\cdot T_o$$

$$T_b = 2716.2\circ R$$

Literature suggests that gas dynamic lasing is most likely to occur when the bulk temperature of the lasing gas is below 750 R (it also suggests that lasing is impossible at bulk temperatures above about 1256 R). The helium does not interact and remains at about 520 R. It will therefore be necessary to pressurize the lasing gas to raise the bulk temperature above the ambient 520 R so that when energized, lasing can occur. Likewise, the gases will have to be cooled to under 1256 R rapidly or the process will not perpetuate.

Section 3 Some Properties of Moist Air

" . . . Madam, of what use is a baby?
Michael Faraday
to
Queen Victoria

The purpose of the laser combustor is to facilitate the operation of an IC engine without the use of hydrocarbon fuels using the properties of moist ambient air coupled to a gas dynamic $CO_2$ laser. In order for the system to be successful, moist air will have to be manipulated to provide the same pVT values calculated in Section 1 of this paper. It is apparent that air itself cannot accomplish this task without the help of the laser. However, the air will be "pushed to its limits", which shall be estimated in this section.

| | |
|---|---|
| Heat capacity of air at initial conditions | $c_{air} := 6.948\cdot\frac{BTU}{mol\cdot F}$ |
| Equation 3.0 . . . Heat capacity of air | $h_o := c_{air}\cdot T_o$ |
| | $h_o := \left(6.948\cdot\frac{BTU}{mol\cdot F}\right)\cdot 60\cdot F.$ |
| | $h_o = 416.880\circ\frac{BTU}{mol\cdot F}$ |

The air follows the pVT laws given in Section 1 and so it is easy to calculate the compression temperature of the air $$p_o\cdot V_o\cdot T_o = p_c\cdot V_c\cdot T_c$$

$T_c$ = 321.658 F. the heat capacity increases to $$c'_{air} := 6.978\cdot\frac{BTU}{mol\cdot F.}$$

As a result, the enthalpy of the air increases to $$h'_{air} := \left(6.978\cdot\frac{BTU}{mol\cdot F}\right)\cdot(321.7)\cdot F$$

-continued $$\Delta H_{air} := h'_{air} - h_o$$

$$h'_{air} = 2244.8 \circ \frac{\text{BTU}}{\text{mol}}$$

$$\Delta H_{air} = 1827.9 \circ \frac{\text{BTU}}{\text{mol}}$$

In terms of heat flux, this energy content is found by converting molar values into molar rates $$\psi = 7.244 \cdot 10^{-6} \circ \frac{\text{mol}}{rev}$$

and the BTU input is given by $Q_{air} := \Delta H_{air} \cdot \psi$ $$Q_{air} = 0.013 \circ \frac{\text{BTU}}{rev}$$

Therefore, the heat flux into the system is $$q_{air} := \frac{Q_{air}}{A_p}$$

$$q_{air} = 1.054 \cdot 10^{-3} \circ \frac{\text{BTU}}{\text{in}^2 \cdot rev}$$

The ratio of the heat flux of the gasoline system to the heat flux of the air system is known as Θ.

$$\Theta := \frac{q_{air}}{q_r}$$

$$\Theta = 0.125$$

This indicates that the laser will have to make up about 88% of the gasoline system heat flux.

Section 4 Laser Component Design

Based on the heat flux calculations in Section 3, the laser combustor will have to have a heat flux capability of $$q_L := q_r - q_{air} \text{ or } q_L = 7.387 \cdot 10^{-3} \circ \frac{\text{BTU}}{\text{in}^2 \cdot rev}$$

The critical laser component design will be the nozzle cross-sectional area. If the laser combustor must provide heat flux as indicated, then Equation 4.0 . . . Heat Input from Laser $$7.387 \cdot 10^{-3} \cdot \frac{\text{BTU}}{\text{in}^2 \cdot rev} = \frac{Q_L}{A_n}$$

$$Q_L := 7.387 \cdot 10^{-3} \cdot \text{BTU} \cdot \frac{A_p}{(\text{in}^2 \cdot rev)}$$

$$Q_L = 9.283 \cdot 10^{-2} \circ \frac{\text{BTU}}{rev}$$

Nozzle Design:

As was noted previously, the energy exchange between the laser gases is accomplished through supersonic expansion through a nozzle. The subject of compressible fluid flow through such a nozzle is within the realm of fluid mechanics, and the development of this discipline is well known. From an engineering standpoint, the most difficult aspect of nozzle flow is the maintenance of proper reservoir and receiver pressures necessary for the avoidance of shock waves in the receiver of the nozzle. There is one, and only one, receiver pressure that will yield isentropic flow through the nozzle . . . if the receiver pressure is above that particular pressure, the nozzle is said to be underexpanded, and an oblique shock wave will emanate from the nozzle accompanied by loss of energy and pressure build. On the other hand, if the receiver pressure is too low, the nozzle is said to be overexpanded and normal shocks along with energy dissipation will be the undesirable result.

Isentropic compressible flow considerations are usually undertaken with the starting or resevoir conditions already known. In this case, the resevoir temperature, $T_o$, has been previously calculated (Section 1) and will be used in this development as well. The resevoir pressure, $p_o$, will be a function of the discharge pressure of upstream mechanical compression, so the resevoir pressure will be assumed to be equal to the compressor discharge pressure which is set at $p_C := 30 \cdot \text{psi}$.

In addition to the two parameters above, the overall energy balance equation will be used to calculate the rest of the nozzle characteristics.

Equation 4.1 . . . Mechanical Energy Equation $$m \cdot \left( \frac{\Delta u^2}{2 \cdot g_c \cdot J} \right) + \Delta H = Q - \frac{W_s}{J}$$

In this instance, the flow is adiabatic (Q=0) and no shaft work is present ($W_s$=0) so Equation 4.1 reduces to the final working relationship $$m \cdot \left( \frac{\Delta u^2}{2 \cdot g_c \cdot J} \right) + \Delta H = 0 \text{ OR } m \cdot \left( \frac{\Delta u^2}{2 \cdot g_c \cdot J} \right) = -\Delta H$$

which says that the energy exchange involves an increase in the kinetic energy of the gas mixture at the cost of a reduction in its internal energy (enthalpy). Therefore, if the resevoir and receiver enthalpies can be calculated, the kinetic energy available for collisional processes will be known.

Equation 4.2 . . . Resevoir Enthalpy $$h_{res} := \left(6167 \cdot \frac{\text{BTU}}{molco}\right) \cdot \left(1 \cdot \frac{molco}{10 \cdot molmix}\right) + \left(4285 \cdot \frac{\text{BTU}}{moln}\right) \cdot \left(1 \cdot \frac{moln}{10 \cdot molmix}\right) \ldots + \left(1.242 \cdot \frac{\text{BTU}}{lbhe}\right) \cdot \left(4 \cdot \frac{lbhe}{molhe}\right) \cdot \left(8 \cdot \frac{molhe}{molmix}\right)$$

$$h_{res} = 1084.9 \circ \frac{\text{BTU}}{\text{mole}}$$

The purpose of the nozzle is to sufficiently excite the nitrogen molecules to a state where resonant vibrational excitement of the carbon dioxide results. A vibrational resonance between these species occurs naturally at the area of kinetic energy equaling approximately 2.3 eV.

"...Vibrational excitation actually plays an important role in the science of gas lasers. The most efficient laser systems designed to date are carbon dioxide/nitrogen and carbon monoxide lasers, and these rely on vibrational transitions for laser action. In the carbon dioxide/nitrogen system, the large vibrational cross section near 2.3 eV in nitrogen, resulting from a resonance, causes the electron distribution function to be sharply cut off. This results in an efficient population of vibrational levels of nitrogen with subsequent transfer to the upper laser state of carbon dioxide (i.e. the assymetric stretch mode[2]..."

The previously specified kinetic of 2.3 eV can be recalculated as a receiver enthalpy, given that the receiver is where lasing is to occur:

$$h_{rec} := \left(2.3\cdot\frac{\text{eV}}{\text{molecule}}\right)\cdot\left(1.602\cdot 10^{-19}\cdot\frac{\text{joule}}{\text{eV}}\right)\cdot\left(1\cdot\frac{\text{BTU}}{1055\cdot\text{joule}}\right)\cdot\left(6.023\cdot 10^{23}\cdot\frac{\text{molecule}}{\text{mole}}\right)$$

$$h_{rec} = 210.4\circ\frac{\text{BTU}}{\text{mole}}$$

2. Bekefi, George; ibid

The enthalpy difference can now be determined:

Equation 4.3 . . . Enthalpy Change $$\Delta H_{gas} := h_{rec} - h_{res}$$

$$\Delta H_{gas} = -874.6\circ\frac{\text{BTU}}{\text{mole}}$$

The increase in velocity, substituting back into Equation 4.1 is $$m\cdot\left(\frac{\Delta u^2}{2\cdot g_c\cdot J}\right) = -(-874.6)\cdot\frac{\text{BTU}}{\text{mole}}$$

$$\Delta u := \left[\left(874.6\cdot\frac{\text{BTU}}{\text{mole}}\right)\cdot\left(\frac{\text{mole}}{104\cdot\text{lb}}\right)\cdot\left[2\cdot\frac{((32.174)\cdot\text{ft}\cdot\text{lb})}{lbf\cdot\text{sec}^2}\right]\cdot\frac{(778\cdot\text{ft}\cdot lbf)}{\text{BTU}}\right]^{0.5}$$

$$\Delta u = 648.9\circ\frac{\text{ft}}{\text{sec}}$$

The resevoir and receiver welocities must both be known in order to lay out the nozzle design. The initial velocity (resevoir) can be found if the critical pressure ratio (r) is known. In this case, the critical ratio is assumed to be $r_c := 0.528$, and the "k ratio" ($c_p/c_v$) is $k_n := 1.4$. So the initial velocity is given by Equation 4.4 . . . Resevoir Velocity $$u_o := \sqrt{\left[\frac{2\cdot k_n\cdot g_c\cdot p_o}{(k_n-1)\cdot\rho_o}\right]\cdot\left(1-r_c^{1-\frac{1}{k_n}}\right)}$$

where $\rho_o := 0.2661\cdot\text{lb}\cdot\text{ft}^{-3}$ from the equation of state.

$$u_o = 546.6\circ\frac{\text{ft}}{\text{sec}}$$

The receiver velocity can now be found utilizing the fact that $\Delta u$ and $u_o$ are now known . . .

$$u_r := \Delta u + u_o$$

$$u_r = 1195.4\circ\frac{\text{ft}}{\text{sec}}$$

Before determining the rest of the nozzle parameters, it will be necessary to determine the Mach Number at each velocity.

Equation 4.5 . . . Mach Number

For resevoir conditions with acoustic velocity $$\upsilon := 806\cdot\frac{\text{ft}}{\text{sec}}$$

$$Ma_o := \frac{u_o}{\upsilon}$$

$$Ma_o = 0.678$$

For the receiver;

$$Ma_r := \frac{u_r}{\upsilon}$$

$$Ma_r = 1.483$$

It is now possible to calculate the other nozzle parameters that are necessary to know before a calculation of laser power can be made.

The receiver and resevoir pressures are found from

Equation 4.6 . . . Nozzle Pressures $$p_i := p_o\left[\frac{1}{[1+0.5\cdot(k_n-1)\cdot Ma^2]^{\left(\frac{1}{1-\frac{1}{k_n}}\right)}}\right]$$

Receiver Pressure:

$$p_r := p_o\cdot\left[\frac{1}{[1+0.5\cdot(k_n-1)\cdot Ma_o^2]^{\left(\frac{1}{1-\frac{1}{k_n}}\right)}}\right]$$

$$p_r = 10.801\circ\text{psi}$$

Throat Pressure:

$$p_t := p_r \cdot \frac{1}{[1 + 0.5 \cdot (k_n - 1) \cdot Ma_r^2]^{\left(\frac{1}{1-\frac{1}{k_n}}\right)}}$$

$$p_t = 3.015 \circ \text{psi}$$

Equation 4.7 . . . Nozzle Temperatures $$T_i := T_o \cdot \left(\frac{p_r}{p_t}\right)^{1-\frac{1}{k_n}}$$

| Receiver Temperature | Throat Temperature |
|---|---|
| $T_r := T_o \cdot \left(\frac{p_r}{p_t}\right)^{1-\frac{1}{k_n}}$ | $T_t := T_r \cdot \left(\frac{p_r}{p_t}\right)^{1-\frac{1}{k_n}}$ |
| $T_r = 1.3 \cdot 10^3 \frac{kg}{s^2 \cdot A \cdot K}$ | $T_t = 1.9 \cdot 10^3 \frac{kg}{s^2 \cdot A \cdot K}$ |

Equation 4.8 . . . Nozzle Densities $$\rho_i := \rho_o \cdot \left(\frac{p_r}{p_t}\right)^{\frac{1}{k_n}}$$

| Receiver Density | Throat Density |
|---|---|
| $\rho_r := \rho_o \cdot \left(\frac{p_r}{p_o}\right)^{\frac{1}{k_n}}$ | $\rho_t := \rho_r \cdot \left(\frac{p_r}{p_o}\right)^{\frac{1}{k_n}}$ |
| $\rho_r = 0.214 \circ \frac{lb}{ft^3}$ | $\rho_t = 0.171 \circ \frac{lb}{ft^3}$ |

The mass velocity at the throat, which is the maximum, is given by $G_t := u_r \cdot \rho_t$ $$G_t = 204.9 \circ \frac{lb}{ft^2 \cdot sec}$$

and at the receiver, $G_r := u_o \cdot \rho_o$ $$G_r = 145.4 \circ \frac{lb}{ft^2 \cdot sec}$$

The critical nozzle diameter relationship can now be found from the fact that the mass flow (m) of the system is constant, and that the mass flux (G) varies according to the cross-sectional area of the nozzle throat. If m = GA, then $$\frac{G_t}{G_r} = 1.409$$

and the area ratios must be the same in the nozzle.

Section 5 Laser Power Calculation

Literature on gas dynamic lasers indicates that the power output of same can be calculated from Equation 5.0 . . . Laser Power Output $$Q'_O := G_t \cdot \Delta H_{gas} \cdot A_n \cdot \left(\frac{\varepsilon_L}{1 - \varepsilon_L}\right)$$

where $A_n$ denotes the cross-sectional area of the nozzle throat with a diameter of $d := 0.75 \cdot in$ $$A_n := \left(\frac{\pi}{4}\right) \cdot d^2$$

$A_n := 0.442 \circ in^2$ and $\epsilon_L$ denotes laser efficiency (20 to 25% is common) but is taken to be conservative at $\epsilon_L := 20 \cdot \%$ $$Q'_o := -\left[\frac{(G_t \cdot \Delta H_{gas} \cdot A_n)}{m} \cdot \left(\frac{\varepsilon_L}{1 - \varepsilon_L}\right)\right]$$

$$Q'_o = 1.3 \circ BTU \cdot sec^{-1}$$

In order to compare the laser combustor output with the required output of the existing IC power system, it is now only necessary to calculate the mass flow required through the laser nozzle to get terms that match the IC system.

$$m'_{gas} := G_t \cdot \frac{A_n}{m}$$

$$m'_{gas} = 6.044 \cdot 10^{-3} \circ \frac{mole}{sec}$$

$$\text{therefore, } \Lambda := \frac{Q'_o}{m'_{gas}}$$

$$\Lambda = 218.6 \circ \frac{BTU}{mole}$$

The answer to Equation 5.0 indicates that a gas dynamic laser with output of $$Q'_o = 1.3 \circ \frac{BTU}{sec}$$

would compare to existing IC engine requirements as follows:

Power requirement (IC system) . . .

$$W_x = 9.914 \cdot 10^3 \circ \frac{BTU}{mole}$$

Power output (laser combustor) . . .

$$\Lambda = 218.6 \circ \frac{BTU}{mole}$$

Comparative Power Ratio . . .

$$\beta := \frac{W_x}{\Lambda}$$

$$\beta = 45.3$$

The total power output of the laser combustor system, including the ambient air as fuel, is given by Equation 5.1 . . . Laser Combustor Combustion Chamber Power $$P_T := \Lambda + h'_{air}$$

$$P_T = 2463.5 \circ \frac{BTU}{mole}$$

and the Comparative Power Ratio becomes $$\beta := \frac{W_X}{P_T}$$

$$\beta = 4.0$$

The laser will have to fire 4 times for every mole of air drawn into the combustion chamber. This does not present a problem as lasers can routinely be Q-switched to fire in as little time as microseconds.

I claim:

1. An apparatus for aiding in ignition of fuel in an internal combustion engine comprising:

means for converting combustion inside of a closed space into rotary motion;

a laser coupled to a distributor;

fiber optic cables running from the distributor;

means for directing laser light into said means for converting;

whereby laser light energy originating at the laser is distributed by the distributor to means for directing laser light where said laser light is used to cause an ignition of fuel within said means for converting;

wherein said fuel comprises humid air;

wherein said fuel specifically excludes gasoline;

wherein said laser further comprises a cavity bounded on two ends by optical components; and the system further comprising a pressure sensor disposed between a port of the cavity and a compressor.

2. An apparatus of claim 1 wherein said laser is a gas laser.

3. An apparatus of claim 2 wherein said gas laser uses a laser gas of substantially 10% carbon dioxide, substantially 10% nitrogen and substantially 80% helium.

4. A system of claim 1 further comprising a laser gas tank and a recycling laser gas port for aiding reuse of laser gases.

5. A system of claim 1 wherein said laser further comprises a compressor coupled to a nozzle throat where gas which is forced under pressure exhibits adiabatic expansion and subsequent lasing.

6. A system of claim 1 wherein said fuel consists of humid air.

* * * * *